US005558167A

United States Patent [19]

Hesse

[11] Patent Number: 5,558,167

[45] Date of Patent: Sep. 24, 1996

[54] PERCUSSION BORING MACHINE

[75] Inventor: Alfons Hesse, Lennestadt, Germany

[73] Assignee: Tracto-Technik Paul Schmidt Speczialmashinen KG, Lennestadt, Germany

[21] Appl. No.: 123,301

[22] Filed: Sep. 17, 1993

[30] Foreign Application Priority Data

Sep. 19, 1992 [DE] Germany ..... 42 31 400.3

[51] Int. Cl.[6] ..... B25D 17/24

[52] U.S. Cl. ..... 173/91; 173/162.1; 173/211

[58] Field of Search ..... 173/210, 211, 173/91, 162.1

[56] References Cited

U.S. PATENT DOCUMENTS

| | | | |
|---|---|---|---|
| 1,248,481 | 12/1917 | Greve | 173/211 |
| 1,554,985 | 9/1925 | Bayles | 173/211 |
| 3,756,328 | 9/1973 | Sudnishnikov et al. | 173/91 |
| 4,427,078 | 1/1984 | Wolters et al. | 173/211 |
| 4,809,789 | 3/1989 | MacFarlane | 173/91 |
| 5,074,364 | 12/1991 | Hesse . | |

FOREIGN PATENT DOCUMENTS

| | | |
|---|---|---|
| 2147035 | 5/1985 | United Kingdom . |

*Primary Examiner*—Scott A. Smith
*Attorney, Agent, or Firm*—Bell, Seltzer, Park & Gibson, P.A.

[57] ABSTRACT

A percussion boring machine having an impact piston axially movable in a housing, a control pipe connected to a compressed air hose and an elastic separator fitted between the housing and the control pipe and held under axial compression, whereby assembly of the separator is simplified. In addition the housing, control pipe and compressed air hose suffer less damage, and the control pipe can be assembled and disassembled more easily.

8 Claims, 3 Drawing Sheets

PERCUSSION BORING MACHINE

TECHNICAL FIELD OF THE INVENTION

The present invention relates to the field of percussion boring machines, and more particularly to a boring machine having an impact piston axially movable in a housing, a control pipe controlling the movement of the impact piston and connected to a compressed air hose, and an elastic separator arranged between the housing and the control pipe.

BACKGROUND OF THE INVENTION AND PRIOR ART

A percussion boring machine of this kind is disclosed in German Offenlegungsschrift 38 33 882, hereby incorporated by reference. There the elastic separator acts as a damping block and when the apparatus is used absorbs unavoidable shocks and vibrations in order to keep these away from the reversing mechanism as much as possible. To facilitate the assembly of the control pipe and the damping block the known percussion boring machine has radial projections on the control pipe and/or on the housing, between which the separator is retained on the control pipe and/or in the housing. Because of the elastic separator between the housing and the control pipe the oscillations and shocks caused by the rapid strokes of the piston are only transmitted to the control pipe and the compressed air hose connection after damping. Thereby fatigue fractures, particularly in the rear part of the housing, can be avoided even after use for long periods and under difficult conditions. Also the control pipe with the hose connection is no longer subjected to the heavy blows and oscillations of the housing, so that there is no risk of it unintentionally working loose. Therefore the compressed air hose can advantageously be fixed by means of a screw coupling. The overall result of this is a longer life for the percussion boring machine.

However, it has been found in use that, mostly as a result of unskillful assembly, the separator can show signs of wear and/or damage after a lengthy period of use, which is attributable to the seating of the elastic separator on the control pipe and/or in the housing being too loose.

OBJECT OF THE INVENTION

It is therefore an object of the invention to improve the known percussion boring machine so as to obtain a considerable increase in the life of the elastic separator so that, preferably, replacement of the separator is only necessary after such a long period of use that servicing of the machine would be necessary anyway.

SUMMARY OF THE INVENTION

In view of the foregoing, the present invention provides a percussion boring machine including an impact piston axially movable in a housing, a control pipe for controlling the movement of the impact piston and connected to a compressed air source, and an elastic separator positioned between the housing and the control pipe and held on at least the housing under axially compression by retaining elements. Preferably the elastic separator contacts both the housing and the control pipe. Prior to axially compressing the elastic separator, the elastic separator is easily pushed onto the control pipe and/or into the housing. However, through axial compression, the elastic separator is fixed and secured not only axially, but also radially, due to radial deformation as a result of the axial compression. This eliminates or minimizes any wear or damage resulting from relative movement between the elastic separator and the housing and/or the control pipe.

Preferred retaining elements include a radial projection on the housing and/or on the control pipe and a retaining ring mounted for applying axial force in the direction of the housing and/or the control pipe. This retaining ring can be axially compressed and retained by clamping bolts disposed parallel to the axis of the boring machine, and which engage on the housing and/or on the control pipe. These clamping bolts may be screwed axially into the rear end of the housing. The retaining ring can also extend beyond the outer diameter of the housing, at least locally. In this case a fastening ring is arranged to bear on a shoulder or on a conical region of the housing, and the clamping bolts can be arranged outside on the housing between the retaining ring and the fastening ring.

Since in this case the retaining ring and the fastening ring extend beyond the outer diameter of the machine housing, this embodiment is chiefly of advantage when a spreader cone is arranged on the housing of the percussion boring machine by which bores can be made in the ground with a diameter greater than that of the percussion boring machine.

The axial compression can also be applied to the elastic separator by means of a device that does not remain permanently on the machine, which engages on the retaining ring and pushes it into the housing until it is aligned with radial bores in the housing, through which radial retaining bolts can then be screwed into the retaining ring.

Again, it is possible to hold the retaining ring in the housing under axial compression by means of a bayonet connection.

BRIEF DESCRIPTION OF THE DRAWINGS

Some of the objects, features and advantages of the present invention having been stated, others will appear as the description proceeds, when taken in conjunction with the accompanying drawings illustrating two exemplary embodiments of the invention in which.

DETAILED DESCRIPTION OF ILLUSTRATED EMBODIMENTS

The present invention now will be described more fully hereinafter with reference to the accompanying drawings in which illustrated embodiments are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 3:
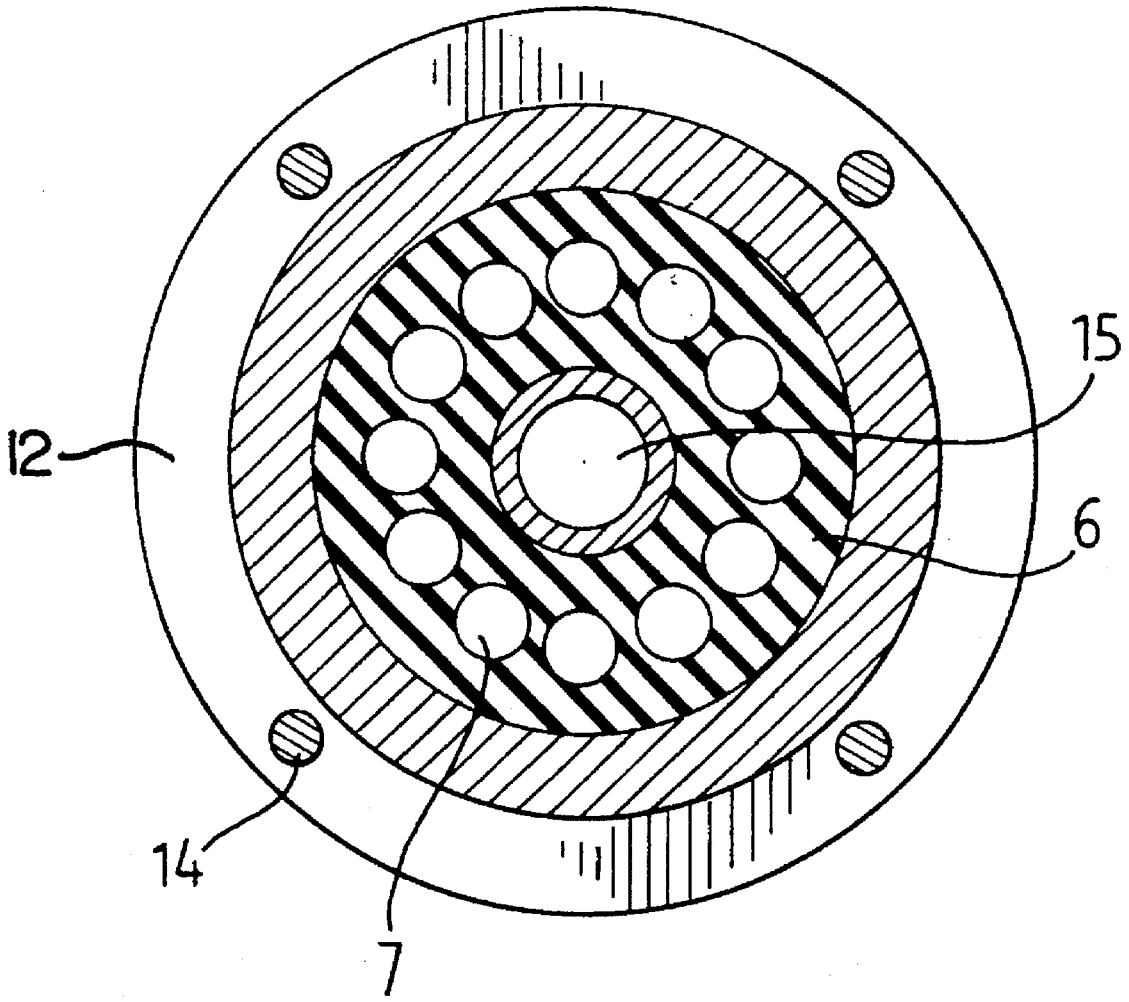
FIG. 3 is a cross-sectional end view taken along line 3—3 of FIG. 1.

Only the housing 1 of the percussion boring machine is illustrated, shown partly cut away at its rear end. An impact piston (not shown) moves back and forth in the housing, its movement being controlled by means of a control sleeve carried on a control pipe 3. Compressed air is supplied to the impact piston via an opening 15 in the control pipe 3. A compressed air hose (not shown) is screwed on to a screw thread 3. The control pipe 2 is connected to the housing 1 by an annular elastic separator 6. The elastic separator 6 may, for example, consist of rubber or polyurethane. The elastic separator 6 prevents the blows and oscillations imparted to the housing 1 by the impact piston from reaching the control pipe 2 and the compressed air hose undamped. The compressed air supplied through the bore 15 to the control pipe 2 escapes to the atmosphere, after the working strokes of the impact piston, through a plurality of axially oriented air outlet openings 7 (shown in FIG. 3), that run concentrically relative to the control pipe 2, through the elastic separator 6.

The elastic separator 6 is fixed to the control pipe Z between a front radial projection around the circumference of the control pipe and a rear radial projection 5 around its circumference. For simplicity the rear circumferential projection 5 is shown here as being integral with the control pipe 2, but it can, like the retaining ring 9 or 16 on the housing 1 described below, be provided as a separate element, for example, in the form of a retaining ring.

In the region of the elastic separator 6 the housing 1 is provided circumferentially with a radial projection 8, against which the front end of the elastic separator 6 bears. An axially projecting cylindrical shoulder 10 of the retaining ring 9 engages with the rear end of the elastic separator 6. This retaining ring 9 bears on the elastic separator only with this axially projecting shoulder 10; it does not bear on the rear end of the housing 1. The retaining ring 9 and the rear end of the outer cylindrical surface of the housing contact one another through frustoconical surfaces, which serve to limit the degree of axial compression applied to the elastic separator 6 and prevent vibration of the retaining ring.

The retaining ring 9 also includes a radial projection 11, for example in the form of an increase in diameter over and beyond the external diameter of the housing 1. Axially displaced from it is fitted a fastening ring 12 which bears on a frustoconical region 13 of the exterior of housing 1. A number of clamping bolts are distributed uniformly around the circumference of the housing 1 and are arranged in bores in the radial projection 11 of the retaining ring 9 and in the fastening ring For assembly of the boring machine, a sub-assembly wherein the elastic separator 6 is supported on the exterior periphery of control pipe 2, is pushed into the housing 1 as far as the radial projection 8. This can easily be done without the use of tools, because adequate clearance exists between the elastic separator 6 and the housing 1. Then the retaining ring 9 is applied to the end of the housing 1 and the clamping bolts 14 are tightened until the desired axial compression of the elastic separator 6 has been achieved. Axial compression of the elastic separator 6 results in simultaneous radial deformation and compression of the elastic separator 6 within the bore in the housing 1, to ensure firm seating of the elastic separator during use.

Figure 1:
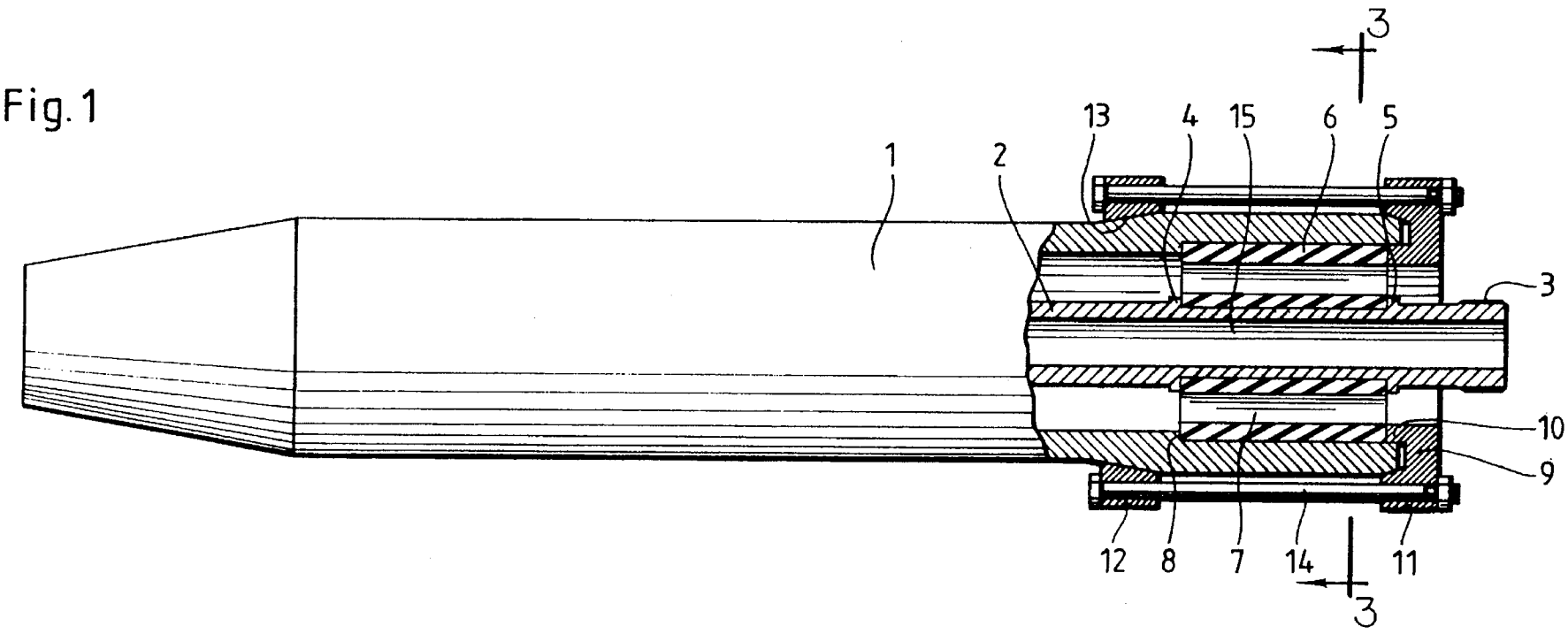
FIG. 1 illustrates a percussion boring machine having portions thereof cut away at the rear end.
Figure 2:
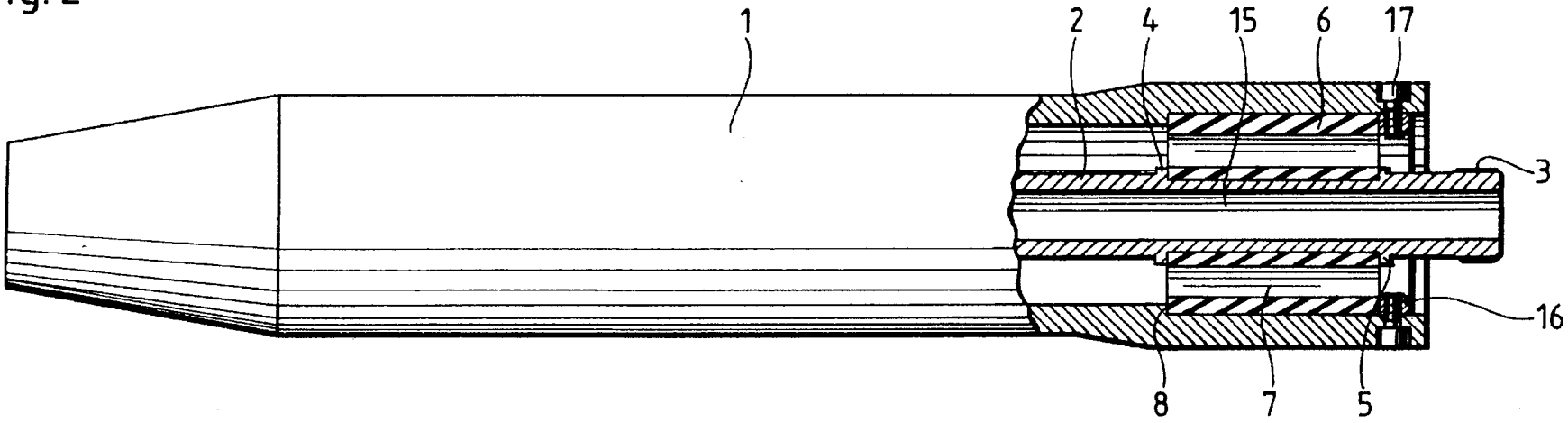
FIG. 2 illustrates another embodiment of a percussion boring machine according to the invention.

While in the embodiment shown in FIG. 1 the axial compression is applied to the elastic separator through the fastening on the housing 1 itself, the embodiment shown in FIG. 2 employs a bearing ring 16 which is first displaced axially inwardly by an auxiliary device (not shown) until the required axial compression has been applied to the elastic separator 6. When the desired axial compression has been attained, radial bores in the retaining ring 16 are aligned with corresponding bores in the housing 1, so that radial retaining bolts 17 can be inserted in these bores to thereby fix the retaining ring 16 in the desired axial location. The auxiliary device for applying the axial compression can then be released from the compression boring machine.

If an auxiliary device is used to apply the axial compression the retaining ring can also be retained in the housing by means of a spring ring or a bayonet connection.

The invention has been described in considerable detail with reference to its preferred embodiments. However many variations and changes can be made without departing from the spirit and scope of the invention as described in the foregoing detailed specification and defined in the appended claims.

What is claimed is:

1. A percussion boring machine comprising:

a housing for receiving an axially movable impact piston, a control pipe for controlling the movement of an impact piston in said housing and being adapted for connection to a compressed air hose, and an elastic separator fitted between said housing and said control pipe and held at least on said housing under axial compression by retaining elements.

2. A percussion boring machine according to claim 1, wherein said retaining elements comprise a radial projection on at least one of said housing and said control pipe and a retaining ring mounted in axially adjustable relation with respect to said at least one of said housing and said control pipe.

3. A percussion boring machine according to claim 2, wherein said retaining ring is retained by means of clamping bolts disposed parallel to the axis of said boring machine and that engage with at least one of said housing and said control pipe.

4. A percussion boring machine according to claim 2, wherein said retaining ring is adapted for applying axial compression to said separator by means of bolts passing radially through said housing and said retaining ring.

5. A percussion boring machine according to claim 2 wherein said elastic separator is positioned within said control pipe between a front radial projection and a rear radial projection formed therein, and between a radial projection on said housing and a shoulder on said retaining ring, thereby enabling said elastic separator to be axially compressed therebetween by said retaining ring.

6. A percussion boring machine according to claim 1 wherein said elastic separator comprises an annular configuration.

7. A percussion boring machine comprising:

a housing for receiving an axially movable impact piston, a control pipe for controlling the movement of an impact piston and for conducting an impact piston to a compressed air hose an elastic separator fitted between said housing and said control pipe and held at least on said housing under axial compression by a radial projection on at least one of said housing and said control pipe and a retaining ring is mounted in axially adjustable relation with respect to said at least one of said housing and said control pipe and wherein said retaining ring is retained by means of clamping bolts disposed parallel to the axis of said boring machine and that engage with at least one of said housing and said control pipe, and a fastening ring which bears on a shoulder on said housing, and wherein said retaining ring projects beyond an external diameter of the housing, said clamping bolts being fitted between said retaining ring and said fastening ring.

8. A percussion boring machine comprising:

a housing for receiving an axially movable impact piston, a control pipe for controlling the movement of an impact piston and being for connecting an impact piston to a compressed air hose, an elastic separator fitted between said housing and said control pipe and held at least on said housing under axial compression by a radial projection on at least one of said housing and said control pipe and a retaining ring mounted in axially adjustable relation with respect to said at least one of said housing and said control pipe and wherein said retaining ring is retained by means of clamping bolts disposed parallel to the axis of said boring machine and that engage with at least one of said housing and said control pipe, and a fastening ring which bears on a frustoconical region of said housing, wherein said retaining ring projects beyond an external diameter of said housing, and said clamping bolts are fitted between said retaining ring and said fastening ring.

* * * * *

UNITED STATES PATENT AND TRADEMARK OFFICE

CERTIFICATE OF CORRECTION

PATENT NO. : 5,558,167

DATED : September 24, 1996

INVENTOR(S) : Alfons Hesse

It is certified that error appears in the above-indentified patent and that said Letters Patent is hereby corrected as shown below:

Col. 3, line 12, "Z" should be --2--.

Col. 3, line 40, after "ring" insert --12.--.

Col. 4, line 46, "conducting" should be --connecting--.

Col. 4, line 47, after "hose" insert a comma (,).

Signed and Sealed this

Eleventh Day of March, 1997

Bruce Lehman

BRUCE LEHMAN

*Commissioner of Patents and Trademarks*

*Attest:*

*Attesting Officer*